US005340322A

United States Patent [19]

Poulsen

[11] Patent Number: 5,340,322

[45] Date of Patent: Aug. 23, 1994

[54] LOW VOLTAGE CABLE LIGHTING SYSTEM

[76] Inventor: Peder U. Poulsen, Huntington Rd. Box 197, Stratford, Conn. 06497

[21] Appl. No.: 51,730

[22] Filed: Apr. 22, 1993

[51] Int. Cl.[5] ..... H01R 25/14

[52] U.S. Cl. ..... 439/111; 439/121; 362/226; 362/391

[58] Field of Search ..... 439/110–112, 439/121; 362/226, 391

[56] References Cited

U.S. PATENT DOCUMENTS

| | | | |
|---|---|---|---|
| 1,171,710 | 2/1916 | Freixas | 362/391 |
| 5,151,037 | 9/1992 | Range et al. | 439/110 |
| 5,158,360 | 10/1992 | Banke | 439/531 |

FOREIGN PATENT DOCUMENTS

| | | | |
|---|---|---|---|
| 4013863 | 10/1991 | Fed. Rep. of Germany | 439/121 |

*Primary Examiner*—Gary F. Paumen

[57] ABSTRACT

Low voltage cable lighting system including a flat cable comprising two bare, ribbon shaped conductors which are plached on each side of and bonded to an insulating interlayer, and a multitude of low voltage bi-pin lamps which are distributed along the cable with each of their contact pins resting against the surface of one of the ribbon conductors, each lamp being secured in place by means of a mounting clamp which contains means for maintaining a stable contact pressure between the contact pins and the ribbon conductors.

4 Claims, 1 Drawing Sheet

Fig. 1
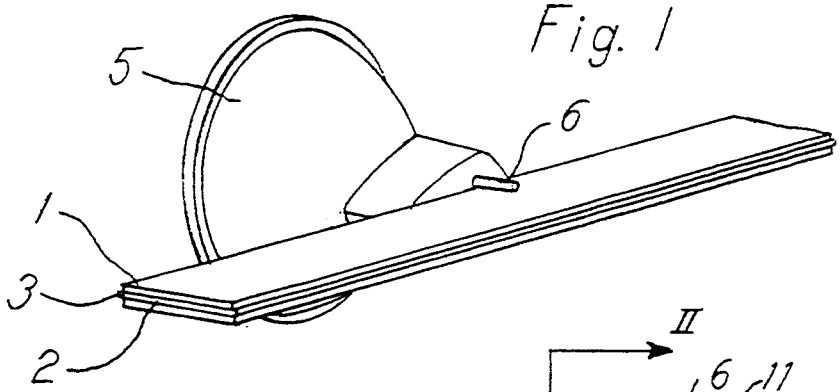
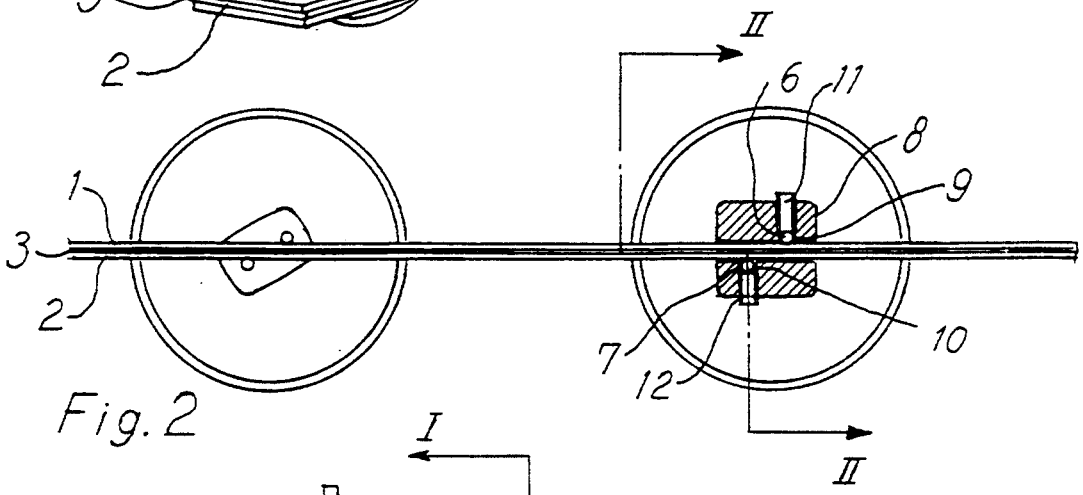
Fig. 2
Fig. 3
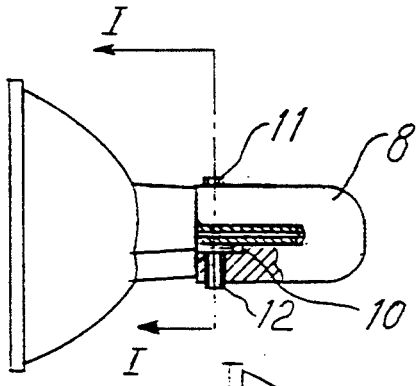
Fig. 4
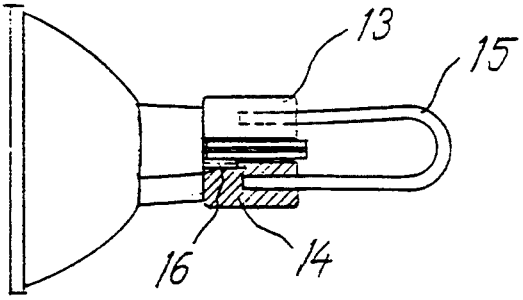
Fig. 5
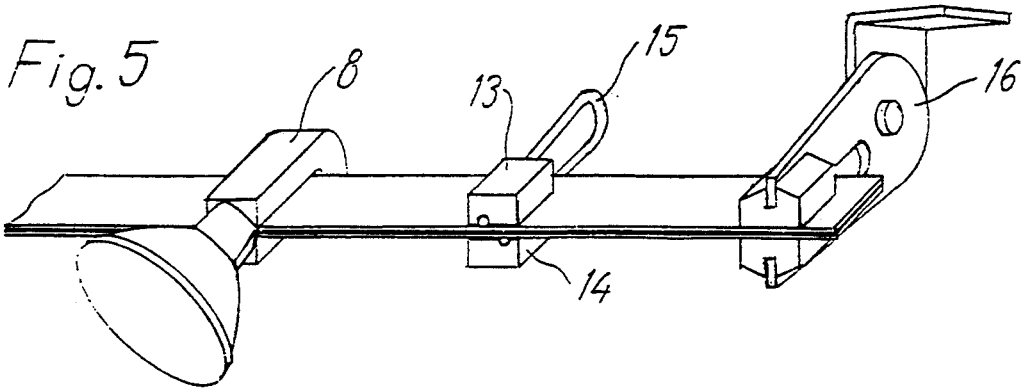

LOW VOLTAGE CABLE LIGHTING SYSTEM

BACKGROUND OF THE INVENTION

The present invention relates to a low voltage lighting system which comprises a multitude of lamps supported by and powered from a flexible, twin conductor cable. The system includes means for suspending the cable and attaching and aiming the lamps individually to provide flood, spot or accent lighting of e.g. paintings on a wall or merchandise on shelves in a store.

Track lighting systems in general comprise a rigid track which is attached to building elements or furniture and supports several lighting fixtures which are fed from live conductors contained within the track structure. The main advantage of track lighting is that, once it is installed, the user can move the fixtures around and aim them without the aid of a licensed electrician and often without the use of tools.

Track lighting using line voltage must have guards to prevent the user from touching the conductors, whereas in low voltage track lighting the track is often open and unprotected because there is no danger of electric shock.

A variety of low voltage track lighting, termed cable lighting, comprises two, parallel conductors in the shape of metal wires or cables which are mounted several inches apart strung out between anchor points in walls or ceilings and at one end connected to a low voltage transformer. In most cable systems the cables support light fixtures via contact organs which rest upon the cables or are attached to them by means of of some kind of clamping device. U.S. Pat. No. 5,158,360 describes such a a cable lighting system wherein the two cables are insulated, and the lighting fixtures provided with insulation piercing contact organs.

SUMMARY OF THE INVENTION

The present invention represents a cross between low voltage track lighting and cable lighting and comprises a flat cable composed of two bare ribbon shaped conductors which are placed on each side of and bonded to an insulating interlayer. A cable according to the invention may be supplied in coil form and strung out across a room between two or more support brackets whereof one may also provide the hook up point to the power source.

It is an important feature of cables according to the invention that their geometry allows direct contact between each of the band conductors and one of the two contact pins of a low voltage bi-pin lamp. Also according to the invention each lamp is attached to the cable by means of a clamp which serves to maintain the necessary contact pressure between the lamp pins and the band conductors. The result is a cable lighting system which provides complete flexibility in the placement of the individual lamps and at the same time eliminates the need for traditional lamp holders with contact springs and screw-in or bayonet type sockets.

The invention will be explained in greater detail in the following with reference to the drawings, in which

BRIEF DESCRIPTION OF THE DRAWINGS

FIG. 1 is a short section of a cable according to the invention with a lamp in position ready for installation.

FIG. 2 is the same, viewed from a point in the center plane, illustrating the relative position of the contact pins above and below the cable, plus a second lamp secured by means of a preferred embodiment of a mounting clamp according to the invention and shown partly in section.

FIG. 3 is the same, viewed from a direction perpendicular to the lamp axis, illustrating a cross section B—B through the cable and part of the mounting clamp shown in FIG. 2.

FIG. 4 is a similar view of another embodiment of a mounting clamp according to the invention, and FIG. 5, a perspective view of a section of cable strung out below a ceiling between adjustable mounting brackets whereof only one is shown, and a lamp mounted on the cable by means of the clamp illustrated in FIG. 2, and 3, plus next to it, the clamp shown in FIG. 4 ready for the insertion of a lamp.

DESCRIPTION OF THE PREFERRED EMBODIMENTS

1 and 2 are ribbon conductors, consisting of e.g. solid bands of copper, which are bonded onto each side of a marginally wider band of insulating material 3, the three elements forming a flat cable which may be coiled for shipping and again uncoiled on the installation site. Typically, in a system with a power rating about 500 watts the dimensions of each conductor may be e.g. 0.01"×0.50" yielding a cross section equivalent with a 12 gauge wire. Resting against the edge of the cable is a bi-pin reflector lamp 5, with each of its pins 6 and 7 contacting one of the ribbon conductors.

The mounting clamp shown in FIG. 2 and 3 may be injection molded from a suitable resin and consists of a fork shaped body 8, with a gap dimensioned to fit over the flat cable. At the open end of the clamp and facing the cable surfaces are two mutually offset slots 9 and 10 which serve to accept the lamp contact pins. The lamp is mounted by inserting the pins in the slots and tightening two set screws 11 and 12 located in threaded bores corresponding with slots 9 and 10, thereby pressing each contact pin firmly against the uninsulated conductor.

The mounting clamp shown in FIG. 4 consists of two identical moldings 13 and 14 which are connected by means of a hairpin spring 15. Each molding is provided with a slot 16 slightly shallower than the thickness of the lamp contact pins and with a tapered lead-in to facilitate insertion. In this embodiment the contact pressure is provided by a steel hairpin spring 15, which means that no set screws are required, and the clamp can be mounted without tools. A variation of this embodiment can be injection molded in one piece, also incorporating the spring member, from a resin with spring like properties.

FIG. 5 is part of a typical installation illustrating the cable strung out between adjustable brackets whereof only one is shown at 16. The system can be angled as desired or aimed vertically downward dependent on bracket design, and additional brackets may be installed to provide in-between suspension and power supply points if required.

The described lighting system has the advantage of extreme flexibility and simplicity because only one cable is required and because only minimal structure is required in addition to the mounting hardware. Unlike other cable lighting systems, including live un-insulated cables, there is very little risk of a short caused by a metal object touching both conductors simultaneously.

Another problem inherent in most low voltage systems is excessive heat generated in the the lamp holders and surroundings due to high current and power densities. The tendency to hot spots at all points of electrical contact causes oxidation of lamp pins and contact springs and possible contact failure. The high temperatures also necessitate the use of porcelain or steatite in lamp holders which sometimes operate at above to 200 degree centigrade. Most cable systems involve four electrical contact points per lamp, namely between the cable and the power take offs and between the contact springs in the lamp holder, and the lamp contact pins, all potential failure points.

The lighting system according to the invention is entirely different in this respect because only two contact points are required per lamp. In addition heat from the filament, radiated and conducted rearwards to the lamp holder is effectively dissipated via the solid line contact between the contact pins and the large-surface cable conductors. As a consequence there is a vastly reduced risk of contact failure, and mounting clamps according to the invention may be injection molded from common, relatively inexpensive resins able to withstand e.g. 130 degrees C.

I claim:

1. A low voltage lighting system comprising two bare, ribbon shaped conductors which are placed on each side of and bonded to an insulating inter-layer, and at least one low voltage bi-pin lamp, each lamp having respective contact pins resting against respective outwardly facing surfaces of the conductors.

2. The low voltage lighting system according to claim 1, further comprising a mounting clamp for maintaining stable contact pressure for a lasting, good electrical connection between the contact pins and the ribbon conductors.

3. The low voltage lighting system according to claim 2, wherein said lamp is held in place by means of set screws.

4. The low voltage lighting system according to claim 2, wherein the contact pressure is provided by means of a hairpin spring.

* * * * *